US009454104B1

(12) United States Patent
Urayama et al.

(10) Patent No.: US 9,454,104 B1
(45) Date of Patent: Sep. 27, 2016

(54) DEVELOPING DEVICE AND IMAGE FORMING APPARATUS

(71) Applicant: FUJI XEROX CO., LTD., Tokyo (JP)

(72) Inventors: Kenta Urayama, Kanagawa (JP); Yasuaki Watanabe, Kanagawa (JP); Jun Abe, Kanagawa (JP); Tomoyuki Yoshii, Kanagawa (JP); Takashi Ochi, Kanagawa (JP); Shinji Okuyama, Kanagawa (JP); Fumiyuki Honda, Kanagawa (JP); Shiho Matsuda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/994,880

(22) Filed: Jan. 13, 2016

(30) Foreign Application Priority Data

Jul. 9, 2015 (JP) ..... 2015-137521

(51) Int. Cl.
*G03G 15/00* (2006.01)
*G03G 15/09* (2006.01)
*G03G 15/08* (2006.01)

(52) U.S. Cl.
CPC ..... *G03G 15/0928* (2013.01); *G03G 15/0812* (2013.01)

(58) Field of Classification Search
CPC ..... G03G 15/0921; G03G 15/09; G03G 15/0812; G03G 15/0808; G03G 2215/0609
USPC ..... 399/267, 277, 274
See application file for complete search history.

(56) References Cited

U.S. PATENT DOCUMENTS

2004/0126147 A1* 7/2004 Kondo ..... G03G 15/0921 399/277
2008/0240793 A1* 10/2008 Kobayashi ..... G03G 15/0921 399/267

FOREIGN PATENT DOCUMENTS

| | | | |
|---|---|---|---|
| JP | H06-52105 | A | 2/1994 |
| JP | H07-261547 | A | 10/1995 |
| JP | H09-193091 | A | 7/1997 |
| JP | H11-24407 | A | 1/1999 |
| JP | 2012-198862 | A | 10/2012 |
| JP | 2013-200547 | A | 10/2013 |

* cited by examiner

*Primary Examiner* — Walter L Lindsay, Jr.
*Assistant Examiner* — Jessica L Eley
(74) *Attorney, Agent, or Firm* — Oliff PLC

(57) ABSTRACT

A developing device includes a developing sleeve and a regulation portion. The developing sleeve includes a magnetism generating portion to which magnetic poles are attached. The developing sleeve holds a developer on an outer circumferential surface. The regulation portion includes a magnetic plate. A first segment connecting a peak position of the magnetic pole disposed at a position facing the magnetic plate and an axial center of the developing sleeve has an angle, with respect to a second segment connecting the magnetic plate and the axial center, equal to or less than 7 degrees on a downstream side in a rotation direction of the developing sleeve and equal to or less than 6 degrees on an upstream side in the rotation direction. An angle of a half value width of the magnetic pole is equal to or greater than 41 degrees to equal to or less than 52 degrees.

5 Claims, 8 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2015-137521 filed Jul. 9, 2015.

BACKGROUND

Technical Field

The present invention relates to a developing device and an image forming apparatus.

SUMMARY

According to an aspect of the invention, a developing device includes a developing sleeve and a regulation portion. The developing sleeve includes a magnetism generating portion therein. A plurality of magnetic poles is attached to the magnetism generating portion in a circumferential direction. The developing sleeve holds a developer on an outer circumferential surface thereof. The developer contains a toner and magnetic carriers having a volume average diameter equal to or greater than 25 μm and equal to or less than 35 μm. The developing sleeve is rotatably driven. The regulation portion is disposed at a distance from the outer circumferential surface of the developing sleeve and that includes a magnetic plate. A first segment connecting a peak position of the magnetic pole disposed at a position where the magnetic pole faces the magnetic plate and an axial center of the developing sleeve has an angle, with respect to a second segment connecting the magnetic plate and the axial center, equal to or less than 7 degrees on a downstream side in a rotation direction of the developing sleeve and equal to or less than 6 degrees on an upstream side in the rotation direction of the developing sleep. An angle of a half value width of the magnetic pole is equal to or greater than 41 degrees to equal to or less than 52 degrees.

BRIEF DESCRIPTION OF THE DRAWINGS

Exemplary embodiments of the present invention will be described in detail based on the following figures, wherein.

DETAILED DESCRIPTION

An example of an image forming apparatus according to an exemplary embodiment of the present invention will now be described. Meanwhile, an arrow H shown in each diagram indicates a vertical direction, and an arrow W indicates a horizontal direction and an apparatus width direction.

<Configuration of Image Forming Apparatus>

Figure 1:
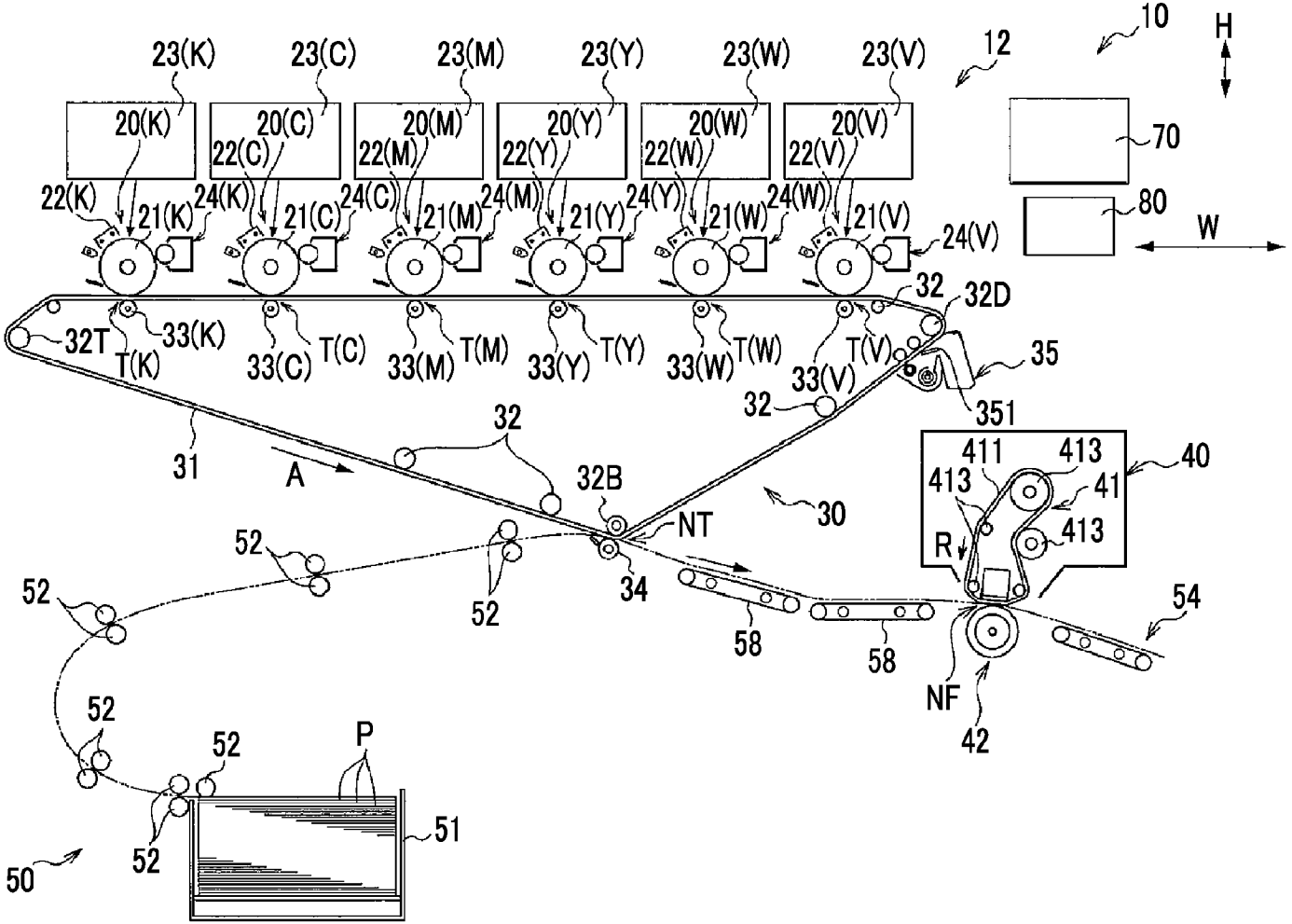
FIG. 1 is a configuration diagram illustrating the configuration of an image forming apparatus according to an exemplary embodiment.

FIG. 1 is a schematic diagram illustrating a configuration when an image forming apparatus 10 is seen from the front side. As illustrated in the drawing, the image forming apparatus 10 is configured to include an image forming section 12 that forms an image on a paper surface (sheet surface) of a sheet-shaped recording medium (sheet member) P such as paper by an electrophotographic process, a transport device 50 that transports a recording medium P, a control section 70 that controls the operation of each section of the image forming apparatus 10, and a power supply section 80 that supplies power to each component.

[Transport Device]

As illustrated in FIG. 1, the transport device 50 includes a container 51 that accommodates the recording medium P, and plural transport rollers 52 that transport the recording medium P to a secondary transfer position NT to be described later from the container 51. Further, the transport device 50 includes plural transport belts 58 transport the recording medium P to a fixing device 40 from the secondary transfer position NT, and a transport belt 54 that transports the recording medium P toward an exit section (not shown) of the recording medium P from the fixing device 40.

[Image Forming Section]

The image forming section 12 includes a toner image forming section 20 that forms a toner image, a transfer device 30 that transfers the toner image formed by the toner image forming section 20 to the recording medium P, and the fixing device 40 that heats and presses the toner image transferred to the recording medium P to thereby fix the toner image onto the recording medium P.

The plural toner image forming sections 20 are provided so as to form a toner image for each color. In the exemplary embodiment, toner image forming sections 20V, 20W, 20Y, 20M, 20C, and 20K of a total of six colors of a first special color (V), a second special color (W), yellow (Y), magenta (M), cyan (C), and black (K) are provided. The signs of (V), (W), (Y), (M), (C), and (K) illustrated in FIG. 1 indicate the above-mentioned colors.

Meanwhile, in the present exemplary embodiment, the first special color (V) and the second special color (W) are corporate colors specific to a user.

[Toner Image Forming Section]

Figure 2:
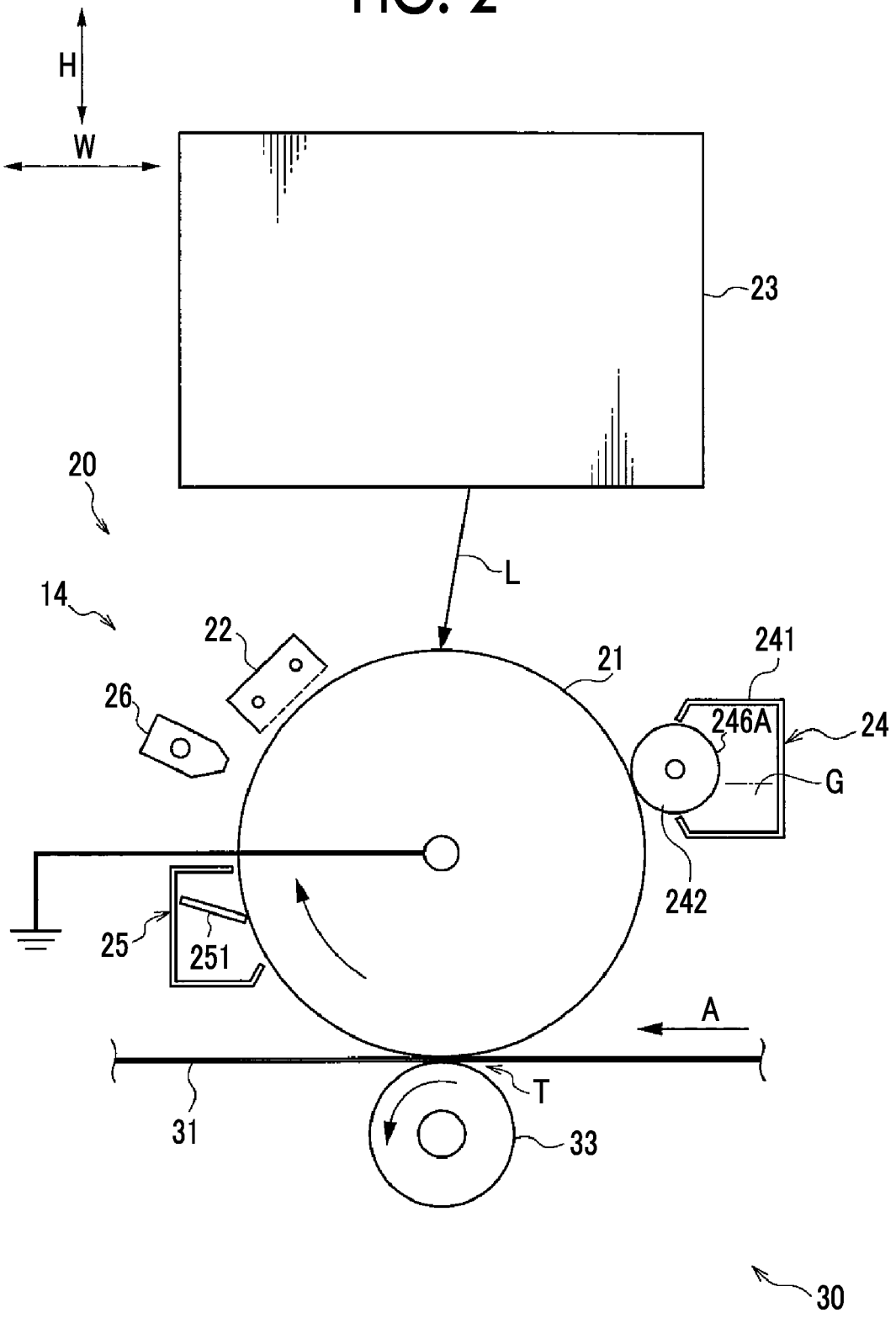
FIG. 2 is a configuration diagram illustrating the configuration of a toner image forming section according to the present exemplary embodiment.

As illustrated in FIG. 1, the toner image forming sections 20 of the respective colors are basically configured in the same manner except for a toner to be used. Specifically, as illustrated in FIG. 2, each of the toner image forming sections 20 of the respective colors includes a photoconductor drum 21 which is rotated clockwise in FIG. 2, and a charger 22 that charges the photoconductor drum 21. Further, each of the toner image forming sections 20 of the respective colors includes an exposure device 23 that forms an electrostatic latent image on the photoconductor drum 21 by exposing the photoconductor drum 21 charged by the charger 22, a developing device 24 that forms a toner image by developing the electrostatic latent image formed on the photoconductor drum 21 by the exposure device 23, a cleaning device 25, and a static eliminator 26.

[Developing Device]

As illustrated in FIG. 2, the developing device 24 is configured to include a container 241 that accommodates a developer G, and a developing roller 242. A developing bias voltage is applied to the developing roller 242, and thus the electrostatic latent image formed on the outer circumferential surface of the photoconductor drum 21 is developed as a toner image due to a potential difference generated between the developing roller 242 and the photoconductor drum 21.

Meanwhile, the structure of the developing device 24 and the developer G will be described later.

(Cleaning Device)

The cleaning device 25 includes a blade 251 that scrapes off a toner remaining on the surface of the photoconductor drum 21 after a toner image is transferred to the transfer device 30, from the surface of the photoconductor drum 21.

[Transfer Device]

The transfer device 30 primarily transfers toner images of the photoconductor drums 21 of the respective colors to a transfer belt 31 (intermediate transfer body) at respective primary transfer positions T to superimpose the toner images thereon, and secondarily transfers the superimposed toner images to a recording medium P at the secondary transfer position NT. Specifically, the transfer device 30 includes the transfer belt 31, a primary transfer roller 33, and a secondary transfer roller 34 as an example of a transfer member.

(Transfer Belt)

As illustrated in FIG. 1, the transfer belt 31 has an endless shape, and is wound around plural rollers 32. Among the plural rollers 32, a roller 32D functions as a driving roller that circulates the transfer belt 31 in a direction of an arrow A by motive power of a motor not shown in the drawing. The transfer belt 31 circulates in the direction of the arrow A to thereby transport a toner image, primarily transferred at the respective primary transfer positions T and superimposed thereon, to the secondary transfer position NT.

In addition, among the plural rollers 32, a roller 32T functions as a tension applying roller that applies tension to the transfer belt 31. Among the plural rollers 32, a roller 32B functions as an opposite roller 32B facing the secondary transfer roller 34.

A cleaning device 35 that cleans the transfer belt 31 is disposed on a downstream side of the secondary transfer position NT and on an upstream side of the primary transfer position T (V) in a circulation direction (direction of the arrow A) of the transfer belt 31. The cleaning device 35 includes a blade 351 that scrapes off a toner remaining on the surface of the transfer belt 31 from the surface of the transfer belt 31.

(Primary Transfer Roller)

Each of the primary transfer rollers 33 is a roller that transfers a toner image on each of the photoconductor drums 21 to the transfer belt 31, and is disposed on the inner side of the transfer belt 31. Each of the primary transfer rollers 33 is disposed facing the photoconductor drum 21 of the corresponding color with the transfer belt 31 interposed therebetween. In addition, a primary transfer voltage having a polarity opposite to that of a toner is applied to each of the primary transfer rollers 33, and thus the toner image formed on the photoconductor drum 21 is transferred to the transfer belt 31 at the primary transfer position T (also see FIG. 2).

(Secondary Transfer Roller)

The secondary transfer roller 34 is a roller that transfers a toner image superimposed on the transfer belt 31 to the recording medium P. The secondary transfer roller 34 is disposed facing the opposite roll 32B mentioned above with the transfer belt 31 interposed therebetween, and the secondary transfer roller 34 and the transfer belt 31 contacts with each other with a predetermined load. In this manner, a position between the secondary transfer roller 34 and the transfer belt 31 which contact in this manner serves as the secondary transfer position NT. The recording medium P is configured to be timely supplied to the secondary transfer position NT from the container 51.

[Fixing Device]

The fixing device 40 fixes a toner image onto the recording medium P to which the toner image is transferred. Specifically, the fixing device 40 is configured to fix a toner image onto the recording medium P by heating and pressing the toner image at a fixing nip NF formed by a pressing roller 42 and a fixing belt 411 wound around plural rollers 413.

[Image Forming Operation]

Next, outlines of a process of forming an image on a recording medium P by the image forming apparatus 10 and a post-treatment process will be described.

The control section 70 having received an image forming instruction operates the toner image forming section 20, the transfer device 30, and the fixing device 40. In addition, the control section 70 operates the transport device 50 and the like in synchronization with the operations thereof.

The photoconductor drums 21 of the respective colors are charged by the charger 22 while rotating. In addition, the control section 70 transmits image data subjected to image processing by an image signal processing section to each of the exposure devices 23. Each of the exposure devices 23 emits exposure light L (see FIG. 2) in accordance with the image data to expose the charged photoconductor drum 21. Thereby, an electrostatic latent image is formed on the outer circumferential surface of each of the photoconductor drums 21. The electrostatic latent image formed on the photoconductor drum 21 is developed by the developing device 24, toner images of a first special color (V), a second special color (W), yellow (Y), magenta (M), cyan (C), and black (K) are formed on the photoconductor drums 21 of the respective colors.

The toner images of the respective colors formed on the photoconductor drums 21 of the respective colors are sequentially primarily transferred to the circulating transfer belt 31 by the primary transfer rollers 33 of the respective colors at the respective primary transfer positions T. Thereby, a superimposition toner image obtained by superimposing the toner images of six colors on each other is formed on the transfer belt 31. The superimposition toner image is transported to the secondary transfer position NT by the circulation of the transfer belt 31. The recording medium P is supplied to the secondary transfer position NT by the transport roller 52 in accordance with a transport timing of the superimposition toner image. The superimposition toner image is secondarily transferred to the recording medium P from the transfer belt 31 at the secondary transfer position NT.

The recording medium P having the toner image secondarily transferred thereto is transported toward the fixing device 40 by a transport belt 58 while being sucked by negative pressure. The fixing device 40 applies heat and a pressing force to the recording medium P passing through the fixing nip NF. Thereby, the toner image transferred to the recording medium P is fixed onto the recording medium P.

The recording medium P having the toner image, fixed by the fixing device 40, thereto is transported by the transport belt 54, and is discharged to an exit section (not shown).

<Configuration of Major Part>

Next, the configuration of the major part of the present exemplary embodiment will be described.

[Developing Device]

Figure 3:
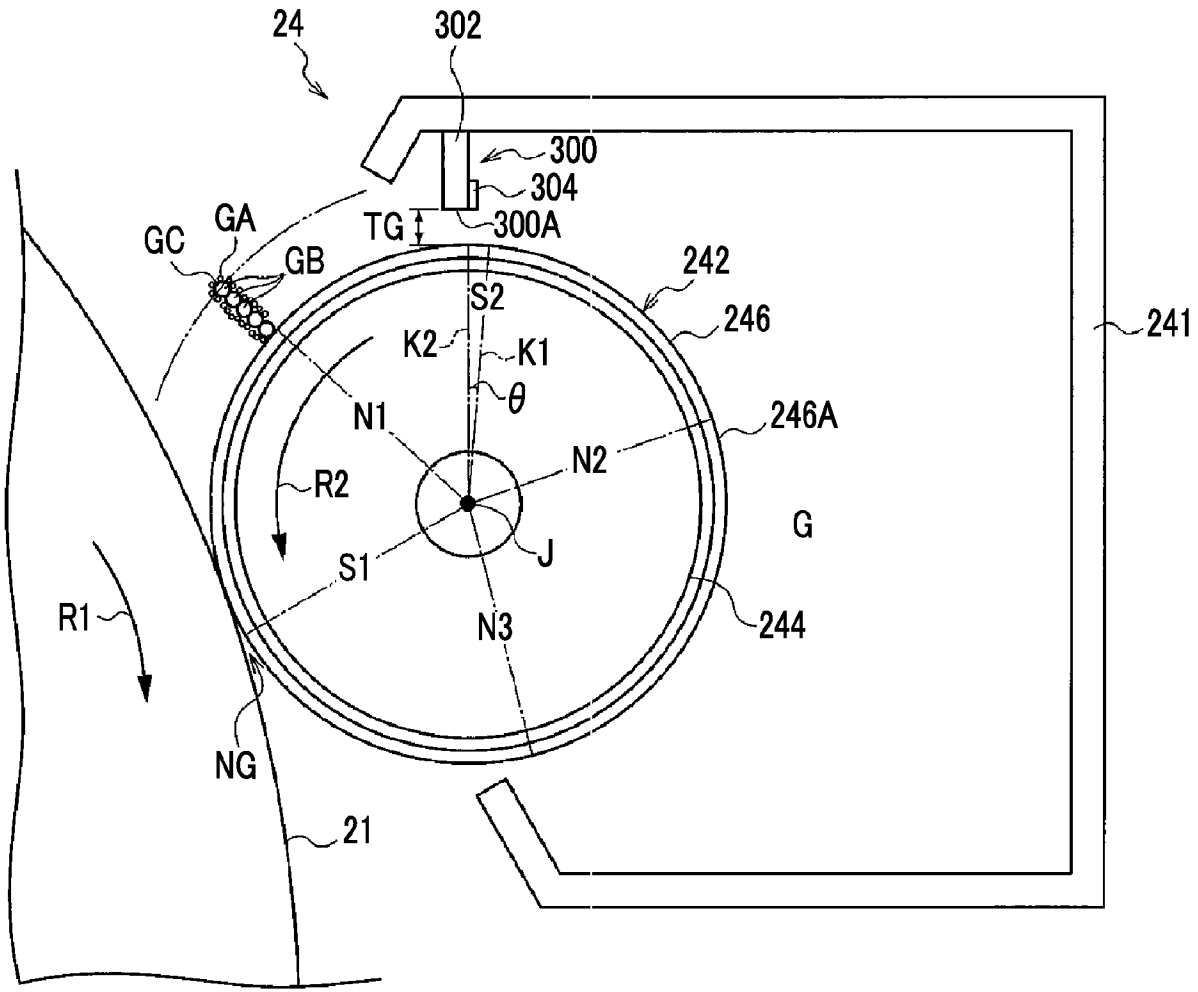
FIG. 3 is a configuration diagram illustrating the configuration of a developing device of the toner image forming section shown in FIG. 2.

As illustrated in FIG. 3, the developing device 24 includes the developing roller 242, and the developer G is accommodated in the container 241 of the developing device 24. Meanwhile, in FIG. 3, magnetic carriers GA, toners GB, and magnetic brushes GC which constitute the developer G to be described later are illustrated larger than their actual sizes.

The developing roller 242 is formed to have a structure in which a magnetism generating member 244 having plural magnetic poles attached to a cylindrical developing sleeve 246 is built thereinto.

The developing roller 242 is disposed facing the photoconductor drum 21 which is rotatably driven, and is rotated in a direction of an arrow R2 which is a rotation direction opposite to a rotation direction R1 of the photoconductor drum 21. Meanwhile, in the developing roller 242 according to the present exemplary embodiment, only the developing sleeve 246 is rotated, and the magnetism generating member 244 inside the developing sleeve 246 is fixed without being rotated.

The developer G is a so-called two-component developer containing the magnetic carriers GA and the toners GB colored in corresponding color.

As described above, in the developing roller 242, the magnetism generating member 244 is built into the developing sleeve 246, and thus the developer G, more specifically, the magnetic carrier GA having the toners GB attached thereto is held on an outer circumferential surface 246A of the developing sleeve 246 (developing roller 242) by a magnetic force.

The developing device 24 is provided with a regulation portion 300 for regulating the amount of developer G (MOS to be described later) which is held on the outer circumferential surface 246A on the developing sleeve 246 (developing roller 242). Meanwhile, the regulation portion 300 will be described later.

In the developing device 24 configured in this manner, the amount of developer G held by the developing sleeve 246 (developing roller 242) is regulated by the developer striking the regulation portion 300, and the developer G having the regulated amount is transported to a developing portion NG which is a portion where the developer G contacts with the photoconductor drum 21.

In the developing device 24, an electrostatic latent image on the photoconductor drum 21 is developed by a so-called reversal developing method in the developing portion NG, and is developed as a toner image. Meanwhile, a developing bias is applied to the developing roller 242 by the power supply section 80 (see FIG. 1).

[Regulation Portion]

The regulation portion 300 extends in an axial direction of the developing roller 242. In addition, a tip portion 300A of the regulation portion 300 is disposed with an interval TG (trimer gap) determined in advance with respect to the outer circumferential surface 246A of the developing sleeve 246 of the developing roller 242. Meanwhile, in the present exemplary embodiment, the interval TG is set to 0.64±0.07 mm.

The regulation portion 300 is configured with a supporting portion 302 bonded to the container 241 and a metal magnetic plate 304 bonded to the supporting portion 302. Meanwhile, a tip portion of the supporting portion 302 and a tip portion of the magnetic plate 304 are formed flush with each other or formed substantially flush with each other, and thus will be referred to as the tip portion 300A as described above without being distinguished from each other.

[Developer]

As illustrated in FIG. 3, the developer G is configured to include the magnetic carriers GA and the toners GB. The toner GB according to the present exemplary embodiment is configured to include a binder resin, an internal additive dispersed in the binder resin, and an external additive dispersed on the surface of the binder resin.

The magnetic carrier GA according to the present exemplary embodiment has a particle size larger than that of the toner GB, and includes a magnetic material such as ferrite particles.

The magnetic carrier GA used in the present exemplary embodiment is a small-diameter carrier having a volume average diameter equal to or greater than 25 μm and equal to or less than 35 μm. Meanwhile, the volume average diameter of the magnetic carrier GA according to the present exemplary embodiment is 30 μm. In addition, the weight susceptibility of the magnetic carrier GA is 41.8 emu/g to 45.7 emu/g when an external magnetic field is 65 mT (corresponding to the center of design of the regulation magnetic pole S2 to be described later).

[Amount of Held Developer (Amount of Developer)]

A design value (desired amount of retention) of the amount of held developer G (amount of developer, mass of sleeve (MOS)) which is regulated by the developer striking the regulation portion 300 of the present exemplary embodiment. In other words, a design value of the amount of developer G, on a downstream side of the regulation portion 300 in the rotation direction (direction of the arrow R2), held on the developing sleeve 246 is 300 g/$m^2$.

[Developing Roller]

The developing roller 242 includes the developing sleeve 246, the magnetism generating member 244 which is built into the developing sleeve 246. Meanwhile, as described above, in the developing roller 242 according to the present exemplary embodiment, only the developing sleeve 246 is rotated, and the magnetism generating member 244 inside the developing sleeve 246 is fixed without being rotated.

The developing sleeve 246 constituting the developing roller 242 is configured as a metal pipe, and contains stainless steel (SUS) in the present exemplary embodiment. In addition, the outer circumferential surface 246A of the developing sleeve 246 is subjected to sandblasting, and the ten-point average roughness Rz of the outer circumferential surface 246A is set to be in a range of 14 μm to 22 μm.

The magnetism generating member 244 constituting the developing roller 242 is a magnet roller obtained by molding powder which is a magnetic material such as ferrite or a rare earth magnet alloy into a columnar shape or a cylindrical shape, and is formed by sintering while being magnetized so that an N pole and an S pole are disposed in a pattern determined in advance.

A developing magnetic pole S1 is disposed at a position corresponding to the developing portion NG, and magnetic poles are disposed on a downstream side of the developing magnetic pole S1 in a rotation direction along a rotation direction R2 of the developing roller 242 (developing sleeve 246) in the order of a pick-off magnetic pole N3, a pick-up magnetic pole N2, a regulation magnetic pole S2, and a transport magnetic pole N1.

The regulation magnetic pole S2 is disposed at a position facing the regulation portion 300. In addition, the magnetic flux density of the regulation magnetic pole S2 is set to 65 mT±5 mT.

Figure 4:
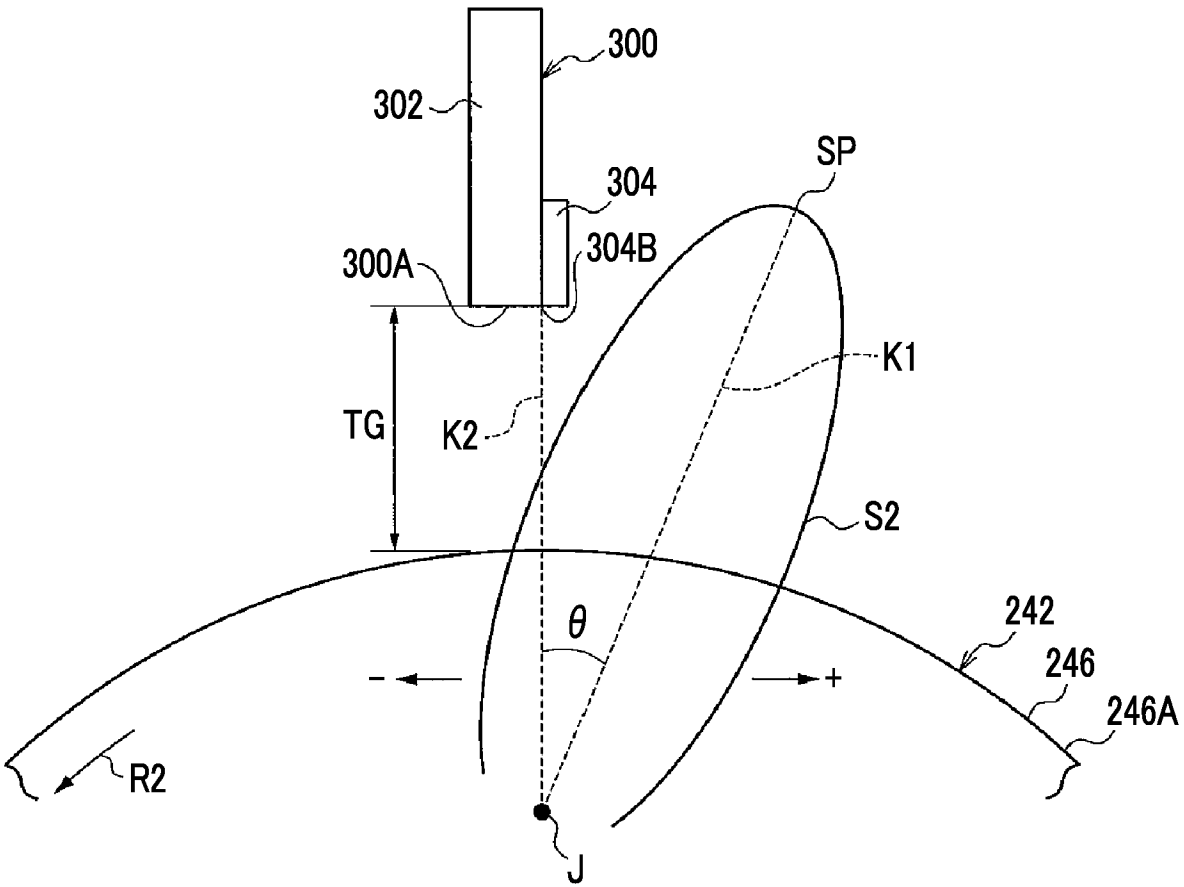
FIG. 4 is a configuration diagram illustrating a peak position of a regulation magnetic pole.

As illustrated in FIG. 4, in the regulation magnetic pole S2, an angle θ formed by a first segment K1, connecting a peak position SP of the magnetic flux density and an axial center J of the developing sleeve 246 (developing roller 242), and a second segment K2, connecting a corner portion 304B on the supporting portion 302 side in the lower end portion of the magnetic plate 304 and the axial center J, is set to be equal to or greater than −7 degrees and equal to or less than +6 degrees (also see FIG. 3). The rotation direction R2 side is a negative side. In other words, the second segment K2 is set to be in a range of equal to or less than 7 degrees on a downstream side in a rotation direction with respect to the first segment K1 and equal to or less than 6 degrees on an upstream side. Meanwhile, in the present exemplary embodiment, the angle θ of the peak position SP is set to 2.0 degrees.

Meanwhile, in FIG. 4, the position and angle θ of the actual axial center J are not accurately illustrated.

Figure 5:
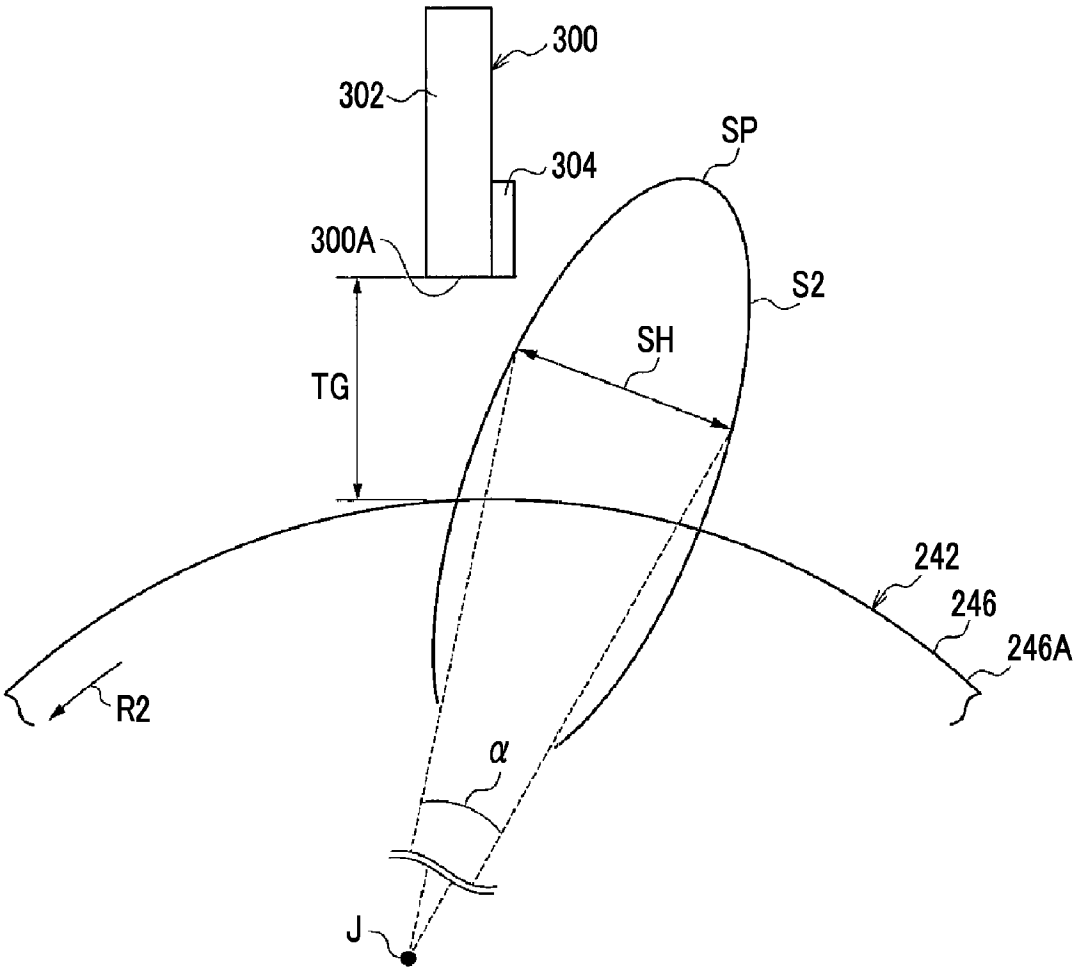
FIG. 5 is a configuration diagram illustrating a half value width of a regulation magnetic pole.

As illustrated in FIG. 5, an angle α of a half value width SH of the regulation magnetic pole S2 is set to be equal to or greater than 41 degrees and equal to or less than 52 degrees. Meanwhile, in the present exemplary embodiment, the angle α of the half value width SH is set to 48.0 degrees.

The half value width SH refers to an angle width of a portion indicating a half value of the highest normal magnetic flux density (vertex) of a magnetic flux density distribution curve in a normal direction in a magnetic pole (regulation magnetic pole S2 in the present exemplary embodiment).

Figure 7:
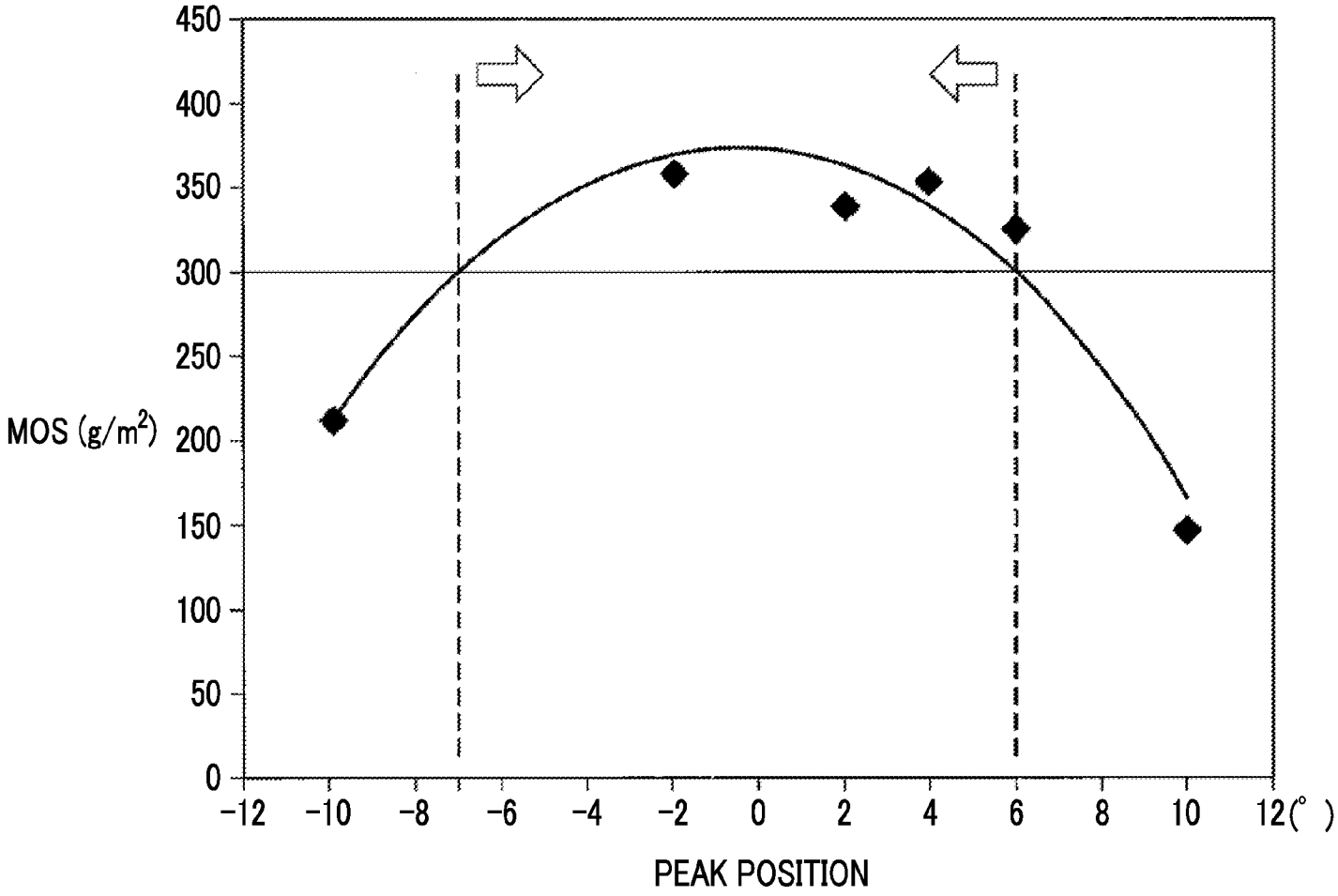
FIG. 7 is a graph illustrating a relationship between the amount of held developer (MOS) and a peak position of the regulation magnetic pole.

Here, FIG. 7 is a graph illustrating a relationship between an angle θ at the peak position SP of the regulation magnetic pole S2 and the amount of held developer G (MOS). Meanwhile, an angle α of the half value width SH is 48.0 degrees.

As described above, a design value (desired amount of retention) of the amount of held developer G which is regulated by the developer G, held by the developing sleeve 246 (developing roller 242) in the present exemplary embodiment, striking the regulation portion 300 in the present exemplary embodiment is 300 g/m$^2$. The angle θ of the peak position SP of the regulation magnetic pole S2 having the amount of retention (MOS) set to equal to or greater than 300 g/m$^2$ is equal to or greater than −7 degrees and equal to or less than +6 degrees. Accordingly, as described above using FIG. 4, the angle θ of the peak position SP of the regulation magnetic pole S2 is set to be equal to or greater than −7 degrees and equal to or less than +6 degrees.

Figure 8:
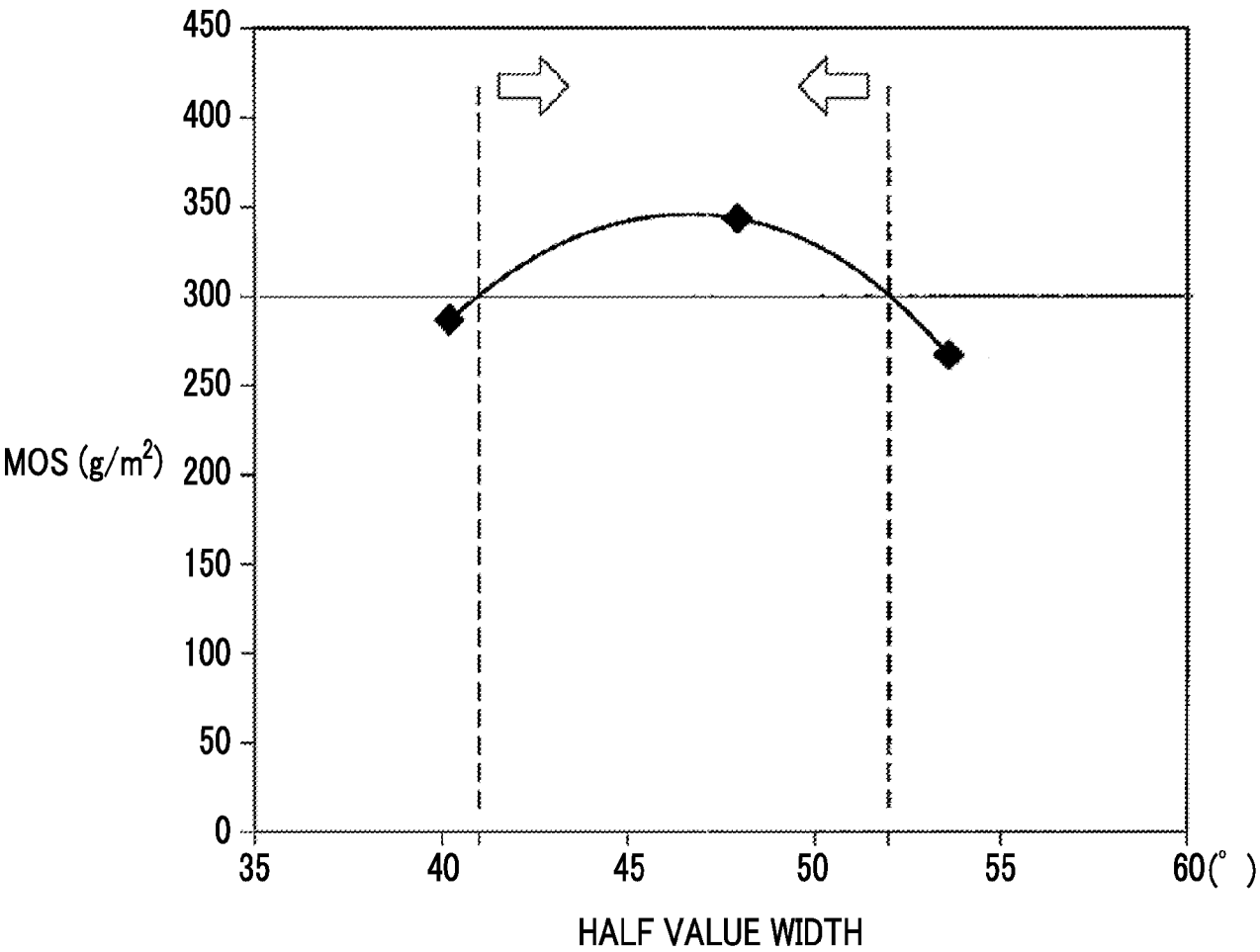
FIG. 8 is a graph illustrating a relationship between the amount of held developer (MOS) and a half value width of the regulation magnetic pole.

FIG. 8 is a graph illustrating a relationship between an angle α of the half value width SH of the regulation magnetic pole S2 and the amount of held developer G (MOS). The angle θ of the peak position SP is 2.0 degrees.

As described above, a design value (desired amount of retention) of the amount of developer G held by the developing sleeve 246 (developing roller 242) of the exemplary embodiment is 300 g/m$^2$. In addition, an angle α of the half value width SH of the regulation magnetic pole S2 having the amount of retention (MOS) equal to or greater than 300 g/m$^2$ is equal to or larger than 41 degrees and equal to or less than 52 degrees. Accordingly, as described above using FIG. 5, the angle α of the half value width SH of the regulation magnetic pole S2 is set to be equal to or larger than 41 degrees and equal to or less than 52 degrees.

<Operation>

Next, the operation of the present exemplary embodiment will be described.

Figure 6:
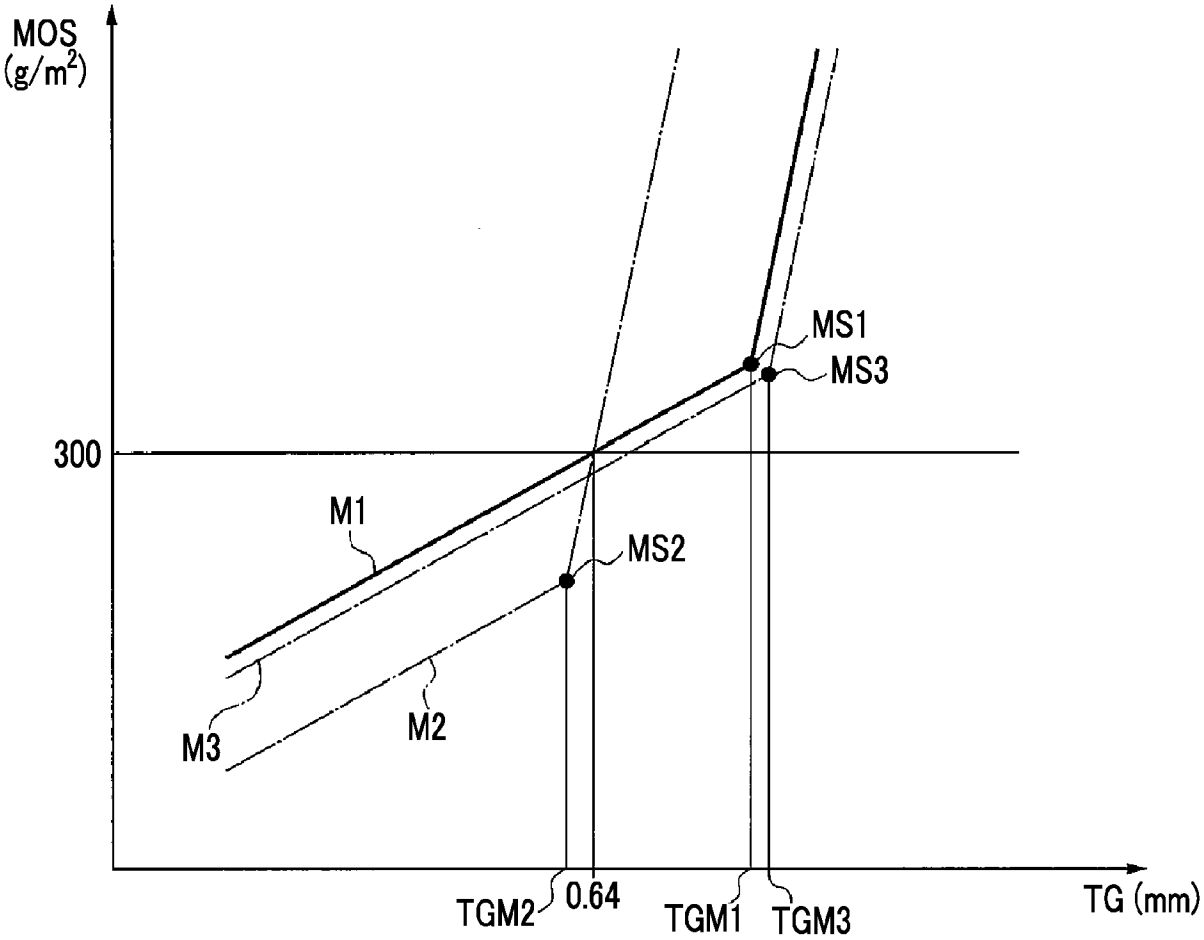
FIG. 6 is a graph illustrating a relationship between an amount of held developer (MOS) and an interval TG.

A solid line M1 shown in FIG. 6 is a graph indicating a relationship between the amount of held developer G (MOS) and an interval TG between the regulation portion 300 and the outer circumferential surface 246A of the developing sleeve 246 of the developing roller 242 in the developing device 24 according to the present exemplary embodiment. In this manner, the amount of held developer G increases as the interval TG gets larger, and has an inflection point MS1 at which the amount of retention increases suddenly when a predetermined interval TG is set. Meanwhile, the interval is referred to as TGM1.

Although a fluctuation range of the amount of held developer G with respect to a fluctuation in the interval TG in equal to or less than the interval TG at the inflection point MS1 is small, a fluctuation range of the amount of held developer G with respect to a fluctuation in the interval TG in a case of being larger than the interval TG at the inflection point MS1 is increased. An increase in the fluctuation range of the amount of held developer G (MOS) may result in defective image quality (wavelike shading).

Here, the cause of the generation of the inflection point MS1 will be described.

A line of magnetic force is generated between the magnetic plate 304 and the regulation magnetic pole S2 by the magnetic plate 304 provided in the regulation portion 300, while results in a state where magnetic carriers GA are continuously connected to each other along the line of magnetic force, thereby exhibiting a shielding effect. However, a magnetic force decreases as the interval TG increases. When the interval is larger than the predetermined interval TG (TGM1), a state where the magnetic carriers GA are continuously connected to each other is not maintained. Thus, a shielding effect is reduced. For this reason, it is considered that a fluctuation range of the amount of held developer G (MOS) is increased.

In the present exemplary embodiment, an angle θ formed by the first segment K1, connecting the peak position SP of the regulation magnetic pole S2 and the axial center J of the developing sleeve 246 (developing roller 242), and the second segment K2 connecting the magnetic plate 304 and the axial center J is set to be equal to or greater than −7 degrees and equal to or less than +6 degrees as illustrated in FIG. 4, and an angle α of the half value width SH of the regulation magnetic pole S2 is set to be equal to or larger than 41 degrees and equal to or less than 52 degrees as illustrated in FIG. 5.

In addition, an interval TG in which a design value of the amount of held developer G (MOS) is set to 300 g/m$^2$ is 0.64 mm, which is equal to or less than the interval TGM1 at the inflection point MS1 as illustrated in FIG. 6, and thus a fluctuation range of the amount of retention with respect to a fluctuation in the interval TG is small. Accordingly, the occurrence of defective image quality (wavelike shading) due to a large fluctuation range of the amount of held developer G is suppressed.

Here, a dashed line M2 in FIG. 6 is a graph indicating a relationship between the amount of held developer G (MOS) and an interval TG according to a first comparative example in which an angle θ of the peak position SP falls outside a range of from −7 degrees to +6 degrees and an angle α of the half value width SH of the regulation magnetic pole S2 falls outside a range of from 41 degrees to 52 degrees. Meanwhile, the other conditions such as a volume average diameter of a magnetic carrier GA are the same as those in the present exemplary embodiment.

In addition, a two-dot chain line M3 in FIG. 6 is a graph indicating a relationship between the amount of held developer G (MOS) and an interval TG according to a second comparative example in which an angle θ of the peak position SP falls outside a range of from −7 degrees to +6 degrees, an angle α of the half value width SH of the regulation magnetic pole S2 falls outside a range of from 41 degrees to 52 degrees, and a large-diameter magnetic carrier GA having a volume average diameter of greater than 35 μm is used.

In the case of the first comparative example (M2), regarding a design value of the amount of held developer G (MOS), an interval TG of 0.64 mm in which 300 g/m$^2$ is set is larger than TGM2 in which an inflection point MS2 is set, and has a large fluctuation range of the amount of retention with respect to a fluctuation in the interval TG.

In the case of the second comparative example (M3), regarding a design value of the amount of held developer G (MOS), an interval TG of 0.64 mm in which 300 g/m$^2$ is set is equal to or less than TGM3 in which an inflection point MS3 is set, and has a small fluctuation range of the amount of retention with respect to a fluctuation in the interval TG.

As in the second comparative example, in a case where the magnetic carrier GA of the developer G is a large-diameter carrier greater than 35 μm, an interval TG3 at an inflection point MS3 is substantially the same as the interval TG1 at the inflection point MS1 according to the present exemplary embodiment even when an angle θ of the peak position SP of the regulation magnetic pole S2 falls outside a range of from −7 degrees to +6 degrees and an angle α of the half value width SH of the regulation magnetic pole S2 falls outside a range of from 41 degrees to 52 degrees.

However, as in the first comparative example, in a case where the magnetic carrier GA of the developer G is a small-diameter carrier which is the same as in the present exemplary embodiment, with regard to the interval TG2 at the inflection point MS2, an interval TG of 0.64 mm in which 300 g/m$^2$ is larger than TGM2 in which the inflection point MS2 is set, when an angle θ of the peak position SP of the regulation magnetic pole S2 falls outside a range of from −7 degrees to +6 degrees and an angle α of the half value width SH of the regulation magnetic pole S2 falls outside a range of from 41 degrees to 52 degrees.

In other words, even when the peak position SP of the regulation magnetic pole S2 and the half value width SH fall outside a range in the present exemplary embodiment, a fluctuation in the amount of held developer G is small in a case of a large-diameter magnetic carrier GA, but a fluctuation range of the amount of retention is increased in the case of changing to a small-diameter magnetic carrier GA.

Consequently, in the present exemplary embodiment, as described above, an angle θ of the peak position SP of the regulation magnetic pole S2 is set to be equal to or larger than −7 degrees and equal to or less than +6 degrees, and an angle α of the half value width SH of the regulation magnetic pole S2 is set to be equal to or larger than 41 degrees and equal to or less than 52 degrees, and thus a reduction in a fluctuation in the amount of held developer G (MOS) is realized even when a small-diameter magnetic carrier GA is used.

Meanwhile, it is also possible to move an inflection point by increasing the magnetic force of the regulation magnetic pole S2. However, in the developing device 24 according to the present exemplary embodiment, it is not possible to sufficiently increase an inflection point even when the magnetic force of the regulation magnetic pole S2 is increased from 65 mT to 80 mT.

In addition, an increase in the magnetic force of the regulation magnetic pole S2 results in a rise in a driving torque of the developing roller 242. For example, when a magnetic force is increased up to 80 mT, 0.241 N·m (2.45 kgf·cm) is set, but 0.181 N·m (1.85 kgf·cm) is set in the case of 65 mT which is a magnetic force in the present exemplary embodiment.

In addition, costs to be incurred are lower in a case of a small-diameter magnetic carrier GA than a large-diameter magnetic carrier GA.

Accordingly, as described above, a peak position SP and a half value width SH of the regulation magnetic pole S2 are set, and thus it is possible to suppress the degradation of image quality by reducing a fluctuation in the amount of held developer G (MOS), to suppress a rise in a driving torque of the developing roller 242, and to reduce running costs even when a small-diameter magnetic carrier GA is used.

In addition, the outer circumferential surface 246A of the developing sleeve 246 of the developing roller 242 according to the present exemplary embodiment is subjected to blasting. Accordingly, a decrease in the amount of held developer G due to a change, with time, of the outer circumferential surface 246A of the developing sleeve 246 (abrasion due to friction) is small as compared to a case where a V-groove is formed in the outer circumferential surface 246A of the developing sleeve 246.

OTHERS

In addition, the present invention is not limited to the above-described exemplary embodiment.

The outer circumferential surface 246A of the developing sleeve 246 of the developing roller 242 according to the above-described exemplary embodiment is subjected to blasting, but is not limited thereto. Accordingly, a V-groove may be formed in the outer circumferential surface 246A of the developing sleeve 246, or may not be processed.

The image forming apparatus may be configured in various ways without being limited to the configuration of the above-described exemplary embodiment. Further, it is needless to say that the present invention can be implemented in various modes without departing from the scope of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developing sleeve that includes a magnetism generating portion therein, a plurality of magnetic poles being attached to the magnetism generating portion in a circumferential direction, holds a developer on an outer circumferential surface thereof, the developer containing a toner and magnetic carriers having a volume average diameter equal to or greater than 25 μm and equal to or less than 35 μm, and is rotatably driven; and a regulation portion that is disposed at a distance from the outer circumferential surface of the developing sleeve and that includes a magnetic plate, wherein a first segment connecting a peak position of the magnetic pole disposed at a position where the magnetic pole faces the magnetic plate and an axial center of the developing sleeve has an angle, with respect to a second segment connecting the magnetic plate and the axial center, equal to or less than 7 degrees on a downstream side in a rotation direction of the developing sleeve and equal to or less than 6 degrees on an upstream side in the rotation direction of the developing sleep, and wherein an angle of a half value width of the magnetic pole is equal to or greater than 41 degrees to equal to or less than 52 degrees.

2. The developing device according to claim 1, wherein the outer circumferential surface of the developing sleeve is subjected to blasting.

3. An image forming apparatus comprising:

an image forming section that forms a toner image on an image holding body by the developing device according to claim 1, and transfers the toner image formed on the image holding body to a recording medium; and a fixing device that fixes the toner image transferred to the recording medium.

4. An image forming apparatus comprising:

an image forming section that forms a toner image on an image holding body by the developing device according to claim 2, and transfers the toner image formed on the image holding body to a recording medium; and a fixing device that fixes the toner image transferred to the recording medium.

5. A developing device comprising:

a developing sleeve that includes a magnetism generating portion therein, the magnetism generating portion having a plurality of magnetic poles, is configured to hold a developer on an outer circumferential surface thereof, the developer containing a toner and magnetic carriers having a volume average diameter equal to or greater than 25 μm and equal to or less than 35 μm, and is rotatably driven; and a regulation portion that is disposed at a distance from the outer circumferential surface of the developing sleeve and that includes a magnetic plate, wherein one of the magnetic pole faces the magnetic plate, a first segment connects a peak position where a magnetic flux density of the one magnetic pole takes a maximum value and an axial center of the developing sleeve, a second segment connects the one magnetic plate and the axial center, in a section view taken along a plane perpendicular to an axis of the developing sleeve, the magnetic flux density of the one magnetic pole takes a half maximum value at half maximum value positions, if the peak position is at downstream of the second segment in a rotation direction of the developing sleeve, an angle between the first and second segments is equal to or larger than 0 degree and equal to or less than 7 degrees, if the peak position is at upstream of the second segment in the rotation direction of the developing sleeve, the angle between the first and second segments is equal to or larger than 0 degree and equal to or less than 6 degrees, and a maximum angle between (i) a segment connecting one of the half maximum value positions and the axial center of the developing sleeve and (ii) a segment connecting another one of the half maximum value positions and the axial center of the developing sleeve is equal to or larger than 41 degrees to equal to or less than 52 degrees.

* * * * *